United States Patent [19]

Spoonts, III

[11] 4,334,457

[45] Jun. 15, 1982

[54] CAPO

[76] Inventor: Paul R. A. Spoonts, III, 5948 Callston La. No. 2030, Fort Worth, Tex. 76112

[21] Appl. No.: 277,705

[22] Filed: Jun. 26, 1981

[51] Int. Cl.[3] ..... G10D 3/04

[52] U.S. Cl. ..... 84/318

[58] Field of Search ..... 84/318

[56] References Cited

U.S. PATENT DOCUMENTS

| | | | |
|---|---|---|---|
| 759,057 | 5/1904 | Almcrantz et al. | 84/318 X |
| 1,518,719 | 12/1924 | Whiteman | 84/318 |
| 3,205,751 | 9/1965 | Lowe | 84/318 |
| 3,504,589 | 4/1970 | Wowries | 84/318 |
| 3,647,930 | 3/1972 | Wowries | 84/318 |

*Primary Examiner*—Lawrence R. Franklin

*Attorney, Agent, or Firm*—James E. Bradley

[57] ABSTRACT

An improved capo for fretted stringed instruments has a pressure bar with a series of threaded bores which are arranged transverse to the length of the instrument strings. Individual adjusting screws received within the bores compensate for variations in diameter of the strings. Rotatable pads on the adjusting screw lower ends remain stationary once a string is contacted while allowing the adjusting screw to continue to turn and tighten on the string.

7 Claims, 3 Drawing Figures

CAPO

BACKGROUND OF THE INVENTION

A capo is a device which allows the player of a fretted instrument, such as a guitar, to temporarily raise the pitch of the instrument. The capo is attached between frets on the neck, or fingerboard, of the instrument thereby clamping all of the strings on the fingerboard at a desired fret location, so that the unfingered pitch of all the strings is raised. Assume, for example, that a particular song is best played in the key of "D", because certain sounds and colorations of the song can only be achieved with techniques in the key of "D". It could be, however, that the vocalist can best perform the song one step higher on the musical scale, in the key of "E", because of his voice characteristics. By using a capo to clamp the guitar strings between selected frets, the guitar player can play the song with the "D" chord progression and techniques while allowing the vocalist to sing in the more comfortable key of "E".

Prior capo designs have generally suffered from a common deficiency. Many stringed fretted instruments, such as guitars, have strings which vary in thickness progressively from one side of the fingerboard to the other. When certain of the prior capo designs are adjusted to hold down all the strings properly, the larger diameter strings are "clamped" or "squeezed" tighter than the smaller diameter strings. As a result, the larger diameter strings are elevated in pitch past the point of relative pitch with the other strings which are squeezed. Thus, a performer who uses a traditional capo on a tuned guitar during a performance will often have to stop temporarily to retune the guitar to compensate for the effect of the capo.

SUMMARY OF THE INVENTION

It is an object of this invention to provide a capo with individually adjustable string contacts to insure that all of the strings are firmly pressed on the fret with as minimum tension as possible.

Another object of the invention is to provide a removably attachable capo which adjusts for individual string thicknesses and which when once adjusted can be removed and reattached to the same instrument without requiring readjustment.

Another object of the invention is to provide a capo which is adjustable for individual string thicknesses and which has string contacts which will not scratch or mar the fingerboard surface.

The improved capo for musical instruments of the type having necks and strings has a pressure bar which has an upper and lower surfaces and is adapted to extend across the neck of the instrument. Mounting means are provided for removably attaching the pressure bar on the neck. An adjusting screw for each string extends through the pressure bar and has an adjusting head which is accessible from the pressure bar upper surface and a lower end. The lower ends are located in a single line transverse to the length of the strings for engaging each string. A pad is mounted on each of the adjusting screw lower ends. Each of the pads is adapted to contact a single one of the strings. Indexing means are provided for indexing the adjusting screws individually upward and downward with respect to the pressure bar to position each adjusting screw for depressing each string firmly against the neck.

Additional objects, features, and advantages will be apparent in the following description.

DETAILED DESCRIPTION OF THE INVENTION

Figure 1:
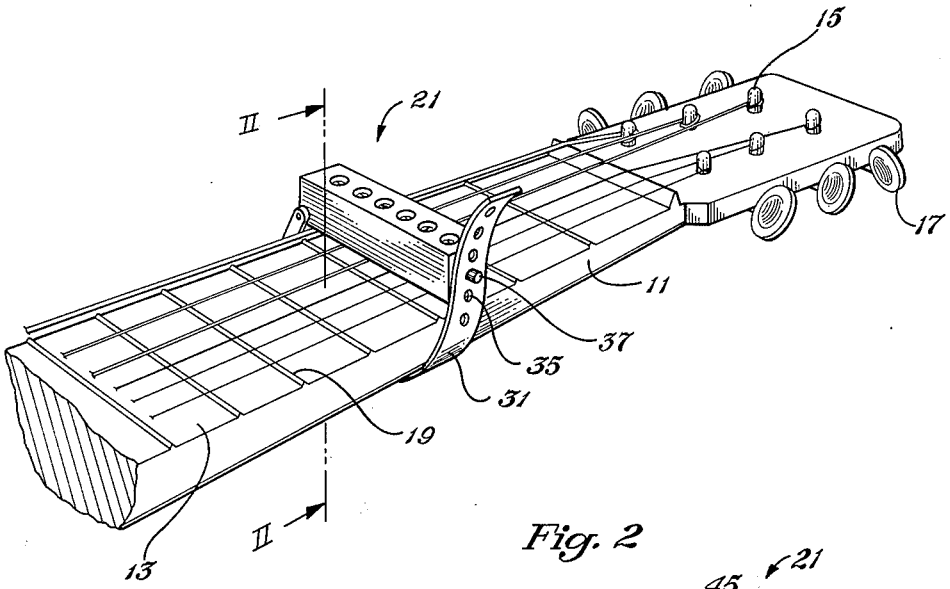
FIG. 1 is a perspective view of a portion of the neck and fingerboard of a guitar showing the capo in place.

Referring now to FIG. 1, there is shown a portion of a guitar neck 11 having the usual six strings 13. Tensioning pegs 15 are used to adjust the pitch of the strings by means of knobs 17. Frets 19 are regularly spaced on the neck 11 transverse to the length of the strings 13 to enable half-tone and greater changes in pitch by depressing the strings onto the different frets.

Figure 2:
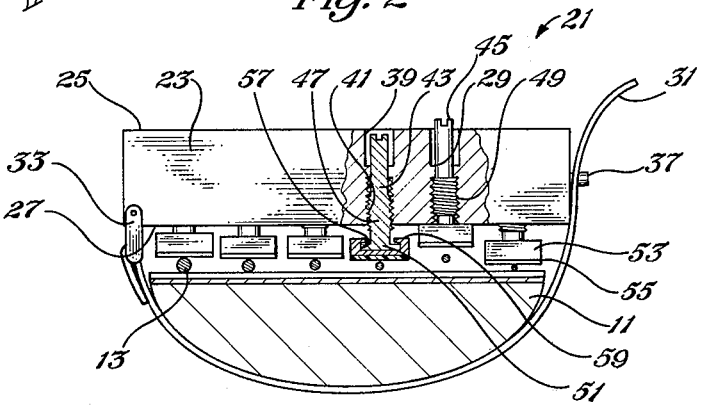
FIG. 2 is a partial cross-sectional view of the capo taken along lines II—II in FIG. 1.
Figure 3:
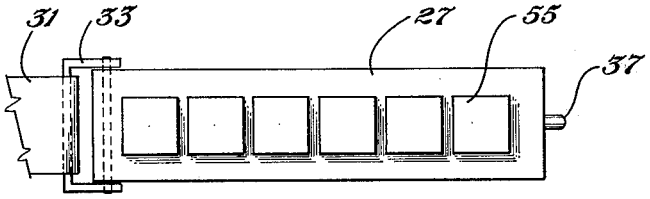
FIG. 3 is a bottom view of the capo of FIG. 1.

The capo, designated generally as 21 in FIG. 1, is shown in greater detail in FIG. 2. The capo 21 includes a pressure bar 23 which has an upper surface 25, and a lower surface 27. Indexing means, including a series of threaded bores 29 connect the upper and lower surfaces. As shown in FIGS. 1 and 2, the pressure bar 23 is adapted to extend across the fretted neck 11 so that the bores 29 are in a line transverse to the length of the strings 13. Mounting means, in this case an adjustable strap 31 is pivotally connected by a link 33 at one corner of pressure bar 23 and has a series of holes 35 which engage a pin 37 on the end of pressure bar 23 opposite link 33. Strap 13 is of an elastic material such as surgical tubing. While the capo is shown in place on a guitar neck, it should be understood that the device can be used with other stringed fretted musical instruments.

Each of the threaded bores 29 has an upper extent 39 of relatively greater internal diameter and a lower threaded extent 41. An adjusting screw 43 is located in each of the bores 29. Each adjusting screw 43 has an adjusting head 45 which is accessible from but normally recessed within the pressure bar upper surface 25. Each adjusting screw 43 also has a lower end 47 which protrudes from the pressure bar lower surface 27. As shown in FIG. 2, the threaded bore upper extent 39 is adapted to receive the adjusting screw head 45 and the lower threaded extent 41 of each bore 29 matingly engages the threads 49 of an adjusting screw 43.

Each adjusting screw 43 has a circular base 51 attached to the lower end thereof. A swivel pad 53 having a soft bottom layer 55 is mounted on each adjusting screw base 51. Each swivel pad has a top recess 57 having an inner bore sized to rotatably receive an adjusting screw circular base 51. A circumferential outer lip 59 formed by the swivel pad top surface contains the adjusting screw base 51 in the recess 57, whereby the base can rotate in the recess when the swivel pad bottom layer 55 contacts the string of the instrument. The bottom surface 55 of pads 53 is preferably rubber although felt or other soft materials which will not scratch the fingerboard surface can be utilized.

The operation of the invention will now be described. As shown in FIG. 1, the capo 21 is attached between the appropriate frets on the neck of the instrument by positioning a pin 37 in the appropriate hole 35 in strap 31. The bores 29 in pressure bar 23 are in a straight line which is transverse to the length of the instrument strings 13. After removably attaching the pressure bar on the fretted neck, a small screw driver or other suitable tool is inserted in the upper extent 39 of bore 29 into the slotted head 45 of each adjusting screw and the adjusting screws are turned in a clockwise direction. As each adjusting screw thread 49 starts to turn in its bore 29, the swivel pad 59 attached to the adjusting screw lower end is driven downwardly toward the string 13. Prior to contacting the string, the swivel pad 53 will be rotating with the adjusting screw as the screw is turned in the threaded bore. Once initial contact is made between the bottom surface 55 of the pad and the string, the pad stops rotating. The adjusting screw 43 can then be turned a portion of a revolution or more with circular base 51 rotating within recess 57 while pad 53 remains stationary. Once the string has been clamped securely, the procedure is repeated with each of the remaining strings and adjusting screws.

The improved capo has significant advantages. Individual adjusting screws in the pressure bar allow the capo to be properly adjusted to compensate for variations in string diameter. Once the capo has been adjusted for a particular instrument, it can be removed and reattached by means of a strap without requiring readjustment of the screws. The swivel pads mounted on the adjusting screw lower ends have soft bottom surfaces for contacting the strings to avoid damaging the strings or fingerboard surface. Because the adjusting screw circular bases are rotatably received within the swivel pad top recesses, the pad remains stationary once the string is contacted even if the screw is tightened further, thereby lessening the chance of damaging the fingerboard surface.

While the invention has been shown in only one of its forms, it should be appreciated by those skilled in the art that it is not thus limited but is susceptible to various changes and modifications without departing from the spirit thereof.

I claim:

1. A capo for a musical instrument of the type having a neck and strings, comprising:

a pressure bar having an upper and lower surface and being adapted to extend across said neck;

mounting means for removably attaching said pressure bar on said neck;

an adjusting screw for each string extending through said pressure bar, each of said adjusting screws having an adjusting head accessible from said pressure bar upper surface and a lower end, the lower ends being located in a single line transverse to the lengths of the strings;

a pad mounted on each of said adjusting screw lower ends, each of said pads being adapted to contact a select one of said strings; and indexing means for indexing said adjusting screws individually upward and downward with respect to the pressure bar to position each adjusting screw for depressing each string against the neck.

2. The capo according to claim 1, wherein each pad will swivel with respect to the screw lower end.

3. A capo for a musical instrument of the type having a fretted neck and strings, comprising:

a pressure bar having an upper and lower surface and a series of threaded bores connecting said upper and lower surfaces, said pressure bar being adapted to extend across said fretted neck so that said bores are in a line transverse to the length of said strings;

mounting means for removably attaching said pressure bar on said fretted neck;

an adjusting screw located in each of said threaded bores, each of said adjusting screws having an adjusting head accessible from said pressure bar upper surface and a lower end;

a circular base fixed to each of said adjusting screw lower ends; and a swivel pad mounted on each of said adjusting screw bases, each of said swivel pads having a recess for rotatably receiving an adjusting screw base, said pads being adapted to contact a select one of said strings by turning said adjusting screws.

4. The capo of claim 3, wherein said threaded bores have an upper extent of relatively greater diameter for receiving an adjusting screw head and a lower threaded extent for matingly engaging an adjusting screw thread.

5. The capo of claim 3, wherein said swivel pads are square.

6. A capo for a musical instrument of the type having a fretted neck and strings, comprising:

a pressure bar having an upper and lower surfaces and a series of threaded bores connecting said upper and lower surfaces, said pressure bar being adapted to extend across said fretted neck so that said bores are in a line transverse to the length of said strings;

an adjustable strap for removably attaching said pressure bar on said fretted neck;

an adjusting screw located in each of said threaded bores, each of said adjusting screws having an adjusting head accessible from but normally recessed within said pressure bar upper surface and a lower end protruding from said lower surface;

a circular base fixed to each of said adjusting screw lower ends;

a swivel pad mounted on each of said adjusting screw bases, each of said swivel pads having a top surface with a recess for rotatably receiving an adjusting screw base and a bottom surface adapted to contact a select one of said strings by turning said adjusting screws.

7. The capo of claim 6, wherein said swivel pad top recesses have an inner bore sized to rotatably receive an adjusting screw base and wherein said recesses have a circumferential outer lip formed by said swivel pad top surface for containing said adjusting screw bases in said recesses whereby said bases can rotate in said recesses when said swivel pad bottom surfaces contact said strings.

* * * * *